United States Patent [19]

Nusser

[11] Patent Number: 4,457,636

[45] Date of Patent: Jul. 3, 1984

[54] METHOD OF ACTUATING PRINTING ELEMENTS AND APPARATUS FOR PERFORMING THE METHOD

[76] Inventor: Alban Nusser, No. 4, Michael-Wening-Strasse, 8050 Freising, Fed. Rep. of Germany

[21] Appl. No.: 419,340

[22] Filed: Sep. 17, 1982

[30] Foreign Application Priority Data

Sep. 22, 1981 [DE] Fed. Rep. of Germany ..... 3137690

[51] Int. Cl.[3] ..... B41J 3/12

[52] U.S. Cl. ..... 400/124; 101/93.05; 400/121; 310/328

[58] Field of Search ..... 400/124, 121; 101/93.05; 310/325, 328

[56] References Cited

U.S. PATENT DOCUMENTS

| | | | |
|---|---|---|---|
| 2,947,886 | 8/1960 | McGunigle | 310/325 |
| 3,937,990 | 2/1976 | Winston | 310/325 |
| 4,272,200 | 6/1981 | Hehl | 400/126 X |

OTHER PUBLICATIONS

*IBM Tech. Disc. Bulletin*, by M. Jakubowski, vol. 12, No. 3, Aug. 1969, p. 481.

*Primary Examiner*—Paul T. Sewell
*Attorney, Agent, or Firm*—John C. Smith, Jr.

[57] ABSTRACT

A method of and an apparatus for actuating printing elements, particularly in matrix printers, is provided. The printing elements undergo a deflection at their free end by electronic measures. At one of their ends the printing elements are driven by at least one stationary clamped drive element, while their free end undergoes a deflection which due to the configuration of the printing element is substantially greater than the deflection of the driven end. The deflection of the free end may be measured and the measured value may be used for the abated return. The drive element operates piezoelectrically or magnetostrictively. The stationary clamping may be effected by a bracing element. Each printing element exhibits a cross section tapering towards the free end. This free end may print directly, or may actuate a further printing unit element.

13 Claims, 11 Drawing Figures

FIG. 2B
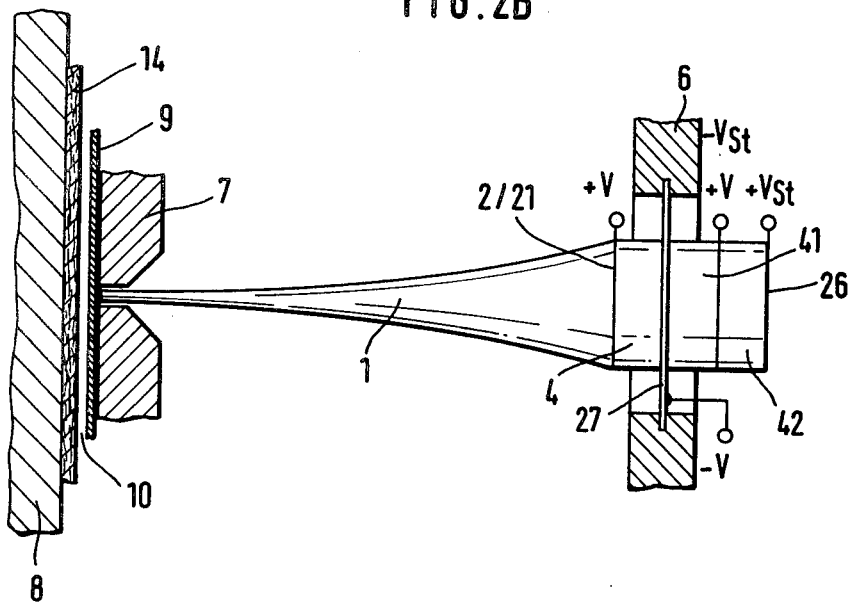
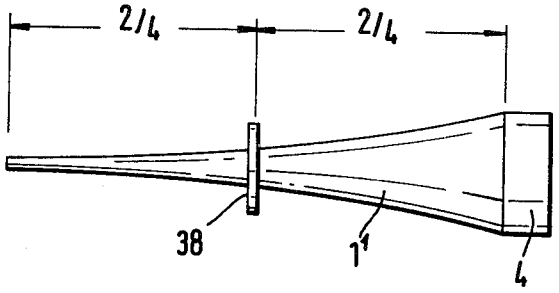
FIG. 3A
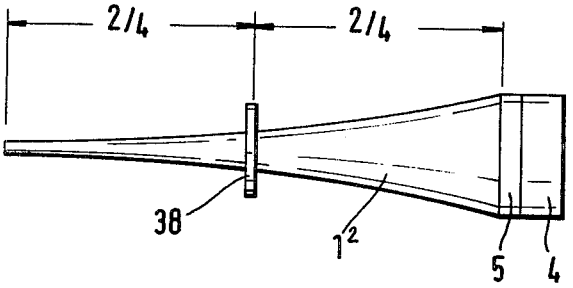
FIG. 3B

METHOD OF ACTUATING PRINTING ELEMENTS AND APPARATUS FOR PERFORMING THE METHOD

BACKGROUND OF THE INVENTION

This invention relates to a method of and an apparatus for actuating printing elements, particularly in matrix printers.

A method of this type has already become known from German Patent No. 26 33 239. Similar methods are known from German Patent No. 23 44 065 and U.S. Pat. No. 3,473,466.

Mechanical transformers (so-called boosters) for enlarging the amplitude of oscillation are studied and described in the paper "A contribution to the question of principal and fault geometry in the ultrasonic oscillating lapping", presented by Dipl.-Ing. Tycho Vetter to the Technische Universität Hannover, Machinery Faculty, and in the paper "Design of high-capacity nozzles for ultrasonic processing", presented by Dipl.-Ing. Horst Scheibener to the Technische Universität Hannover, Machinery Faculty.

Disadvantages of the conventional printing elements are the maximum attainable printing frequencies of approximately 2,000 Hertz, as a result of the electromagnetic losses (leakage field, eddy current) in the masses required to build up the magnetic forces.

SUMMARY OF THE INVENTION

It is an object of the present invention to avoid these disadvantages and to provide a method of and an apparatus for actuating printing elements, particularly piezoelectrically driven printing elements, which makes it possible to control the piezoelectrically driven printing elements precisely and thus to achieve a high printing speed with simultaneous high impression force, shortest possible impression blur and relatively low noise level and low power loss.

To attain this object the present invention provides a method of actuating printing elements, particularly in matrix printers, having a driven end and a free end to which a deflection is imparted by electronic measures, comprising the step of driving the driven end of the printing elements by at least one stationary clamped drive element so that to the free end a deflection is imparted which is substantially greater than the deflection imparted to the driven end.

The apparatus for carrying out this method into effect comprises at least one stationary clamped drive element for driving the driven end of the printing elements so that to the free end a deflection is imparted which is substantially greater than the deflection imparted to the driven end, each printing element having a cross section tapering in the direction towards the free end of the printing element.

The arrangement according to the invention permits printing frequencies which are far above 2,000 Hertz and up to approximately 50,000 Hertz and higher. Also the losses which occur (losses resulting from the internal damping and losses in the piezoelectric crystal arrangement) are low.

In the case of a relatively slight variation in the length of the piezoelectric crystal arrangement, e.g. 1.0 to 1.5 micrometer, this variation is transformed by the transmission ratio of the printing element as stroke amplifier, also called booster below, into a greatly enlarged deflection of the booster tip into a stroke of approximately 0.3 millimeter. A high resolution of the printed image is achieved simultaneously by the small diameter of the booster tip resulting from the required booster transmission ratio.

The actuation frequency of the printing unit in the ultrasonic range ensures a substantial noise reduction within the human audibility range in comparison with conventional mechanical high-speed printers.

In the application of the booster characteristics to the described printing method, only a single booster deviation is generated in each case, which is caused, i.e. excited, by a voltage impulse produced by a control arrangement, not described in detail here, and leaves behind an impression on the record carrier.

By at least one fresh excitation, the counter-excitation, of the booster, its recoil energy can be compensated so that the booster tip returns abated into its initial position without further after-oscillation if the next possible impression or impressions are not required to be executed.

In a particularly advantageous embodiment of the invention the electrical parameters of charge displacement or displacing current and the curve of voltage over time at the electrodes of the piezoelectrical drive element are evaluated by an electrically recording test circuit and the voltage impulses producing the excitation and counterexcitation of the booster are regulated both in their intensity and in time.

BRIEF DESCRIPTION OF THE DRAWINGS

Some preferred embodiments of the invention will now be described by way of example and with reference to the accompanying drawings in which:

FIG. 2B is a view similar to that shown in FIG. 2A of another embodiment of the printing system;

FIGS. 3A–3D show further embodiments of the driven printing element or booster;

DESCRIPTION OF THE PREFERRED EMBODIMENTS

Favorable embodiments and the principle of operation of piezoelectrically operated printing systems are described below in detail with particular reference to FIGS. 1, 2A and 2B.

Figure 1:
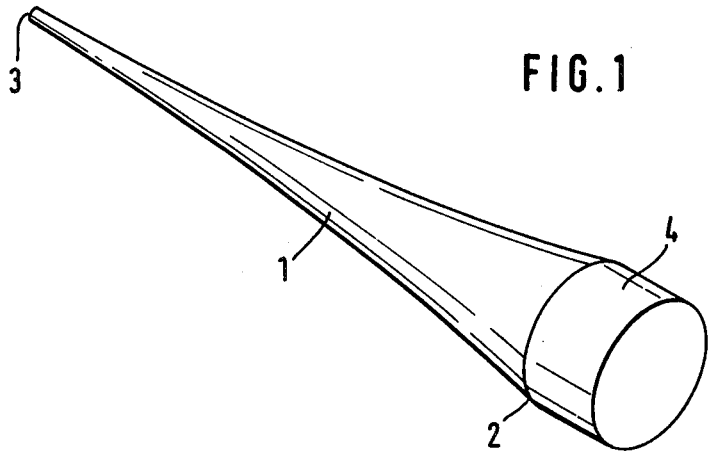
FIG. 1 is a schematic perspective view of a piezoelectrically driven printing element.

FIG. 1 shows a printing element 1 which constitutes a stroke amplifier (booster) and has a circular cross section tapering steadily from the booster foot towards the free end 3 of the booster constituting the booster tip. A piezoelectric drive element 4, likewise of circular cross section, is firmly attached to the booster foot. The piezoelectric drive element 4 may consist e.g. of piezoceramic material and may be glued to the booster foot at the driven end 2 of the printing element 1. Electrodes which cover the total end faces are attached to the two circular end faces of the drive element 4.

Figure 2A:
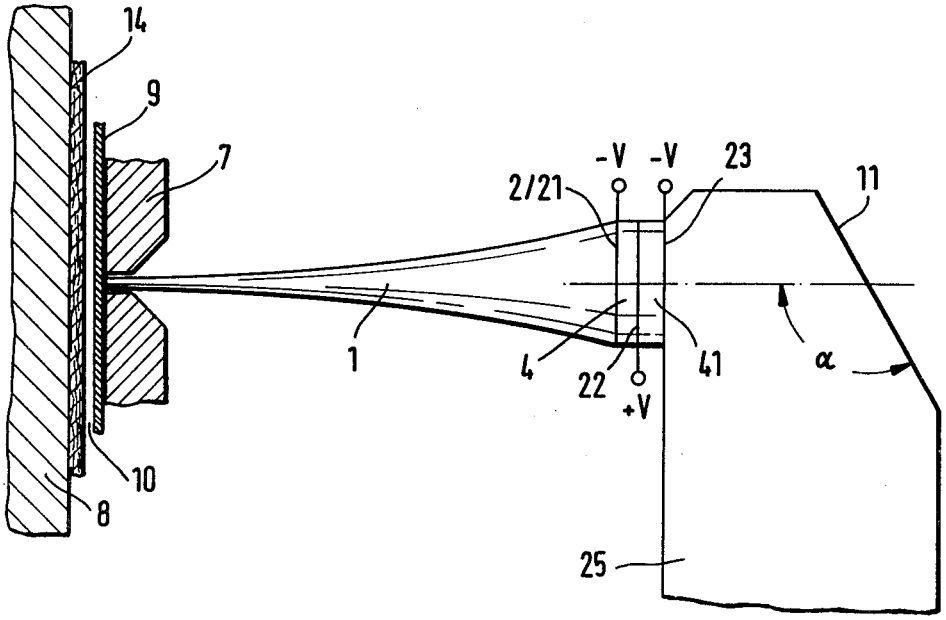
FIG. 2A is a schematic elevational view of a printing system.

FIG. 2A shows a piezoelectrically driven printing system of extremely favorable construction with a stroke amplifier, the booster, in the form of a hyberbolic tube with a unilateral piezocrystal arrangement, in which the individual piezocrystal elements, as piezoelectric drive elements 4 and 41, are connected electrically in parallel and mechanically in series with reference to their operative expansion, so that the pole faces of the same polarization polarity confront each other in each case. The entire piezocrystal arrangement would always comprise an even number of piezoelectric drive elements, so that the terminals for the positive pole of the voltage supply, which lie inside this arrangement, are shielded by the earthed negative potential of this voltage supply at the external electrodes. The driven end 2 of the booster is connected e.g. by gluing to the drive element 4 through an electrode 21 of the latter, the drive element 4 through an electrode 22 to the drive element 41, and the latter in turn through its electrode 23 to a bracing element 25. The drive elements 4 and 41 exhibit the same cross section as the booster foot.

Upon appropriate excitation the drive elements 4 and 41 undergo an operative expansion in the axial direction of the booster. This movement influences both the booster base and also the bracing element 25. The bracing element 25 has on its side remote from the piezoelectrical drive elements 4 and 41 a bevel 11 of angle $\alpha$, so that the shock waves induced by the drive elements 4 and 41 in the bracing element 25 are deflected into a safe direction. The tip, i.e. the free end 3 of the booster is guided in a booster bearing 7 which is contacted, e.g. directly, by an ink carrier 9. A record carrier 14 is movable past a support 8 at an interval 10 which prevents any accidental ink transfer from the ink carrier 9 to the record carrier 14. The described process permits a continuous passage of the record carrier 14 at a high constant speed, of up to 8.4 meters per second in the arrangement dimensioned as follows.

Figure 4A:
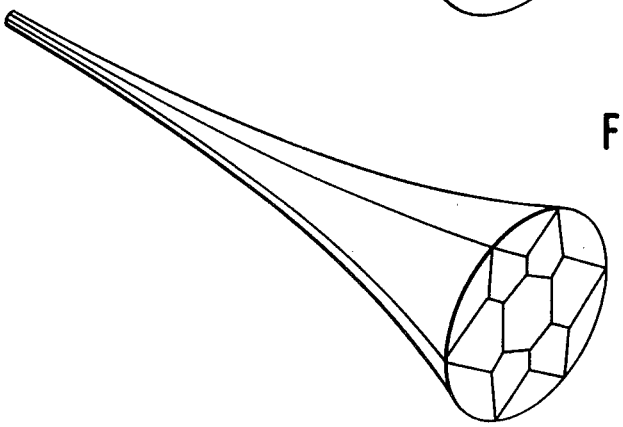
FIGS. 4A–4C show further embodiments of the printing element or booster.
Figure 4B:
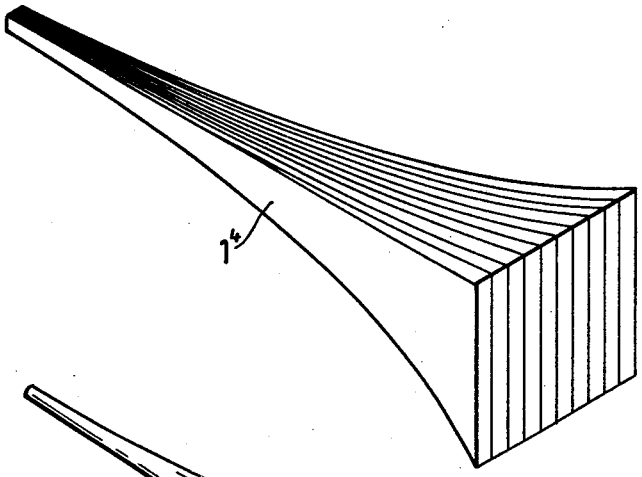
Figure 4C:
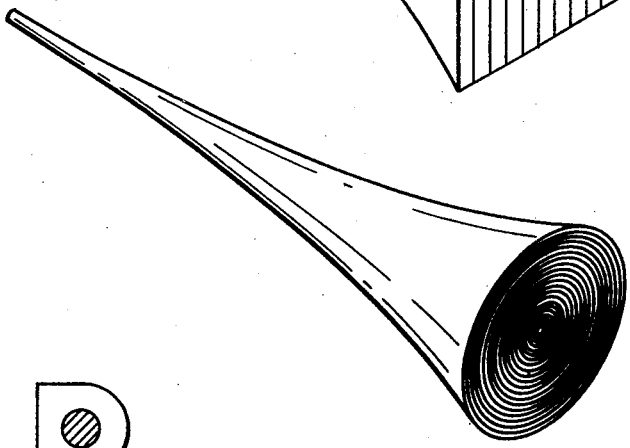

An even higher natural frequency of the booster with a favorable length, is indispensable for the obtention of a high printing frequency. Such a high natural frequency is ensured by a low density and a high modulus of elasticity of the booster material. In view of the high mechanical stresses which occur, a high relative rigidity of the booster is also necessary in order to ensure service of the booster in the elastic range for a low density. The relative rigidity is the ratio of the modulus of elasticity to the specific density. A booster of high relative rigidity may be constructed either with a laminated structure, as illustrated in FIGS. 4A to 4C, or from fiber laminate materials.

The same also applies to the construction of the bracing element 25.

In order to ensure very good resolution of the printed image, the diameter of the booster tip has been chosen as 0.2 millimeter in the embodiment described. For a multiple paper impression, with e.g. 3 carbon copies, a minimum stroke of the booster tip of approximately 0.26 millimeter is necessary. The use of a carbon fiber with an ultimate load of 21,100 Newtons per square millimeter is provided for the construction of the booster, which, for a favorable length of the booster of 50 millimeters, still ensures its operation with a maximum mechanical stress of 4,340 Newtons per square millimeter in the elastic range and its natural frequency of 112 kHz. The printing system is favorably tuned in first approximation when the piezoelectrical drive elements 4 and 41 exhibit the same natural frequency of 112 kHz as the booster. The carbon fiber with a sonic impedance of 23.6 kg/(mm$^2$sec) is combined with piezoelectric drive elements 4 and 41 made of a piezoceramic material "PXE 4" (Valvo Company) with approximately the same sonic impedance of 24.0 kg/(mm$^2$sec), so that prejudicial reflections of the shock waves at the material transitions are prevented or kept as small as possible. For the same reason, and so that the oscillation node of the system is likewise located, in first approximation, at the electrode 22, the bracing element 25 is favorably constructed of the same material as that of the booster, whilst here, just as in the case of the booster, the preferential direction of the carbon fibers coincides with the shock wave direction. The thickness of the drive element 41, which is precisely constructed, is governed by the material and configuration of the bracing element 25 so that the oscillation node of the printing system during the printing operation lies so far as possible in the electrode 22, whilst the thickness is probably slightly less than that of the drive element 4. The natural frequency of the entire printing system is typically 56 kHz, i.e. half the natural frequency of the booster and of the drive element 4. In order that the piezoelectric drive elements 4 and 41 made of the "PXE 4" ceramic exhibit the same natural frequency as the booster of 112 kHz, their thickness is made 8.25 millimeters. For an assumed maximally admissible mechanical stress in the drive elements 4 and 41 of 60 Newtons per square millimeter, a maximum admissible deflection of these drive elements 4 and 41 of 1.18 micrometers is obtained, which dictates a 219-fold stroke enlargement in order to obtain the deflection of 0.26 millimeter of the free end 3 of the printing element 1, i.e. of the booster tip necessary for printing. This necessary transmission ratio of 219 for the booster (hyperbolic tube) gives a diameter of the booster foot of 15 millimeters for a diameter of the booster tip of 0.2 millimeter.

A deflection of the booster base in the printing direction by the drive elements 4 and 41 in the form of a shock wave therefore causes a deflection stepped up 219-fold of the booster tip, likewise in the printing direction, after the shock wave has travelled the entire length of the booster at the speed of sound for its material. The same applies to a deflection counter to the printing direction.

The described printing system therefore promises 56,000 (fifty-six thousand) printing operations per second for a speed of the printing system relatively to the record carrier 14 of 8.4 meters per second and an impression blur of approximately 75 micrometers. The impressions of the booster tip on the record carrier 14 then overlap mutually by approximately 25% in each case.

If the length of the booster and the thickness of the piezoelectrical drive elements 4 and 41 are doubled, then, for the same deflection of the booster tip and the same transmission ratio of the booster, the maximum mechanical stresses in the booster and in the drive elements 4 and 41 are reduced to one-half, whilst the printing frequency likewise decreases to one-half.

The piezoelectrical drive elements 4 and 41 are modulated through the modulating electrodes 21, 22 and 23. The modulation itself occurs through the circuit arrangement, not explained in detail here, which permits a chronologically precise modulation of the electrodes by the application of an electrical field.

It is possible to provide within the modulating arrangement a test circuit which records the time pattern of the analog electrical voltage caused at the electrodes 21, 22 and 23 by the resulting mechanical stress in the drive elements 4 and 41 and feeds it to an evaluation circuit by which corrective excitation and counterexcitation impulses can be generated.

FIG. 2B shows another highly favorable embodiment of the further developed printing system. The printing element 1, i.e. the booster, is attached, e.g. again by gluing, to the piezoelectrical drive element 4, the latter and the piezoelectrical drive element 41 likewise firmly to a membrane 27, which is e.g. preferably electrically conductive in this embodiment, through which the overall oscillating system consisting of the booster, the two drive elements 4 and 41 and a further piezoelectric element 42 attached, e.g. likewise by gluing, to the drive element 41, is mounted with damped resilience on a frame 6. The further piezoelectric element 42 acts primarily as a neutral dynamic counterweight for the booster. The three piezoelectric elements 4, 41 and 42 preferably consist of the same piezoceramic material and preferably have the same cross section and shape as the booster foot and equal thickness. The further piezoelectric element 42 is designated below as the control element 42.

The drive elements 4 and 41 and the control element 42 are here likewise connected electrically in parallel and mechanicallly in series with reference to their operative expansion, so that the pole faces of the same polarization polarity confront each other in each case. The material of the booster, of the drive elements 4 and 41, of the control element 42 and of that part of the membrane 27 present between the cross sections of the two drive elements 4 and 41 preferably exhibit the same sonic impedance in order to prevent prejudicial reflections of the shock waves.

The arrangement of the booster bearing 7, of the ink carrier 9, of the record carrier 14 at the interval 10 and of the support 8 for the record carrier 14 corresponds to that of the embodiment described with reference to FIG. 2A.

The principle of operation of the embodiment illustrated in FIG. 2B is likewise identical to that of the embodiment of the printing system illustrated in FIG. 2A, with the difference that the electrically conductive membrane 27 assumes the electrical function of the electrode 22 and the counterexcitation equivalent to the damping induced by the record carrier 14 and the ink carrier 9 is performed by loading the electrodes $+V_{St}$ and $-V_{St}/+V$ (in FIG. 2B) by the control element 42. The drive element 41 is likewise modulated with the excitation and/or counterexcitation impulses through the electrode $-V_{St}/+V$. All the electrodes cover the same cross-sectional area of the piezoelectric elements. In case it is proposed to use an electrically nonconductive membrane, the drive elements 4 and 41 are provided with particular electrodes at this cross-sectional surface.

The cross-sectional surface 26 of the control element 42 covered by the electrode $+V_{St}$ can oscillate freely without obstruction by the environment.

FIGS. 3A and 3B show two further embodiments of the piezoelectrically operated printing element $1^1$ with a booster in the form of a lambda semi-oscillator which exhibits a collar 38 for mounting the printing element in the position of the oscillation node of the overall oscillating system. This embodiment has the advantage that the total excitation or counterexcitation energy introduced into the piezoelectrically operated printing system is transmitted into the booster. In FIG. 3B a further piezoelectric element 5 is inserted as sensor between the printing element $1^2$ and the piezoelectric drive element 4.

Figure 3D:
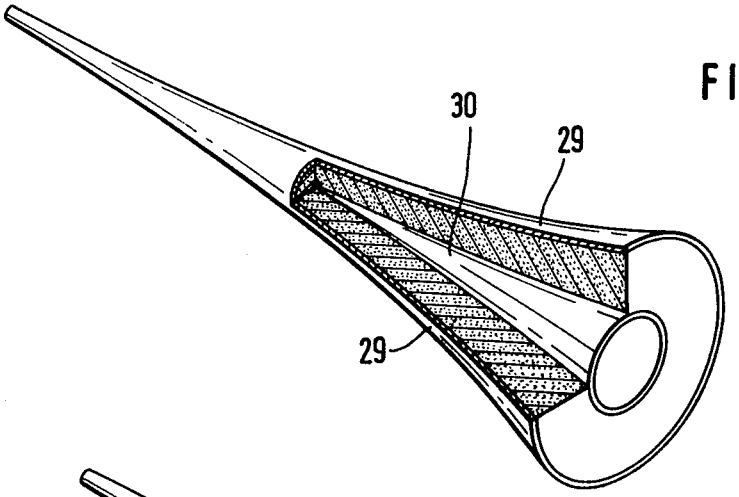

FIG. 3D shows a sectioned piezoelectrically operated printing element, in which the booster is constructed from a material with piezoelectric characteristics so that it is excited through an electrode 30 constructed in the booster core and an electrode 29 applied to the envelope surface of the booster. The booster may also be excited by magnetostrictive elements instead of by the piezoelectrical elements, in which case the possibility of recording and regulating by means of the test and evaluation circuit is retained.

Figure 3C:
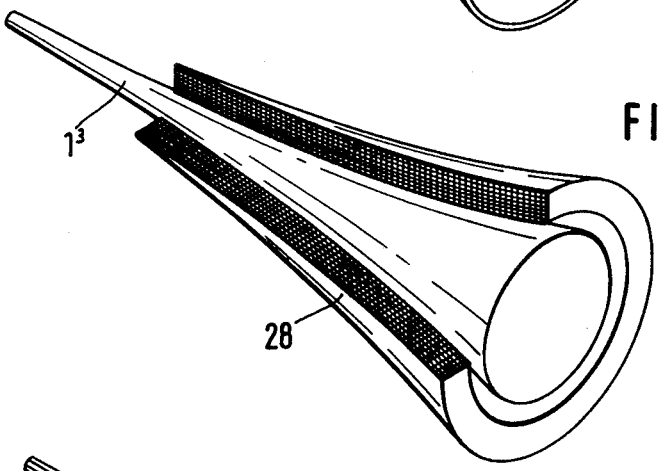

FIG. 3C shows a magnetostrictively operated printing element $1^3$ with an excitation coil 28 shown sectioned, in which the booster is constructed of a material with magnetostrictive characteristics.

The booster may have different cross-sectional shapes and exhibit a cross-sectional shape at the booster tip different from the cross-sectional shape of the booster foot, if the cross-sectional transition is made continuous.

Greater strength of the booster can be achieved by a laminated construction, in which case the direction of the lamellae preferably coincides with the direction of the shock waves and/or expansion waves.

FIG. 4A shows a booster constructed from shaped wires, here e.g. from hexagonal wires, which are firmly mutually connected and the cross section of which preferably likewise tapers (due to cold shaping and/or hot shaping) in conformity with the tapering of the booster.

FIG. 4B shows e.g. a booster of rectangular cross section, constructed from firmly mutually connected plates or foils, the cross section of which likewise preferably tapers due to cold shaping and/or hot shaping in conformity with the tapering of the booster.

FIG. 4C shows e.g. a booster produced from a plate coil or foil coil of firmly mutually connected windings, in which the coil has been shaped into the booster by subsequent deformation (cold shaping and/or hot shaping).

The booster may also be constructed in the form of a lamella which exhibits constant thickness as far as the booster tip. Due to this embodiment of the boosters, they can be continuously mutually aligned.

Figure 5:
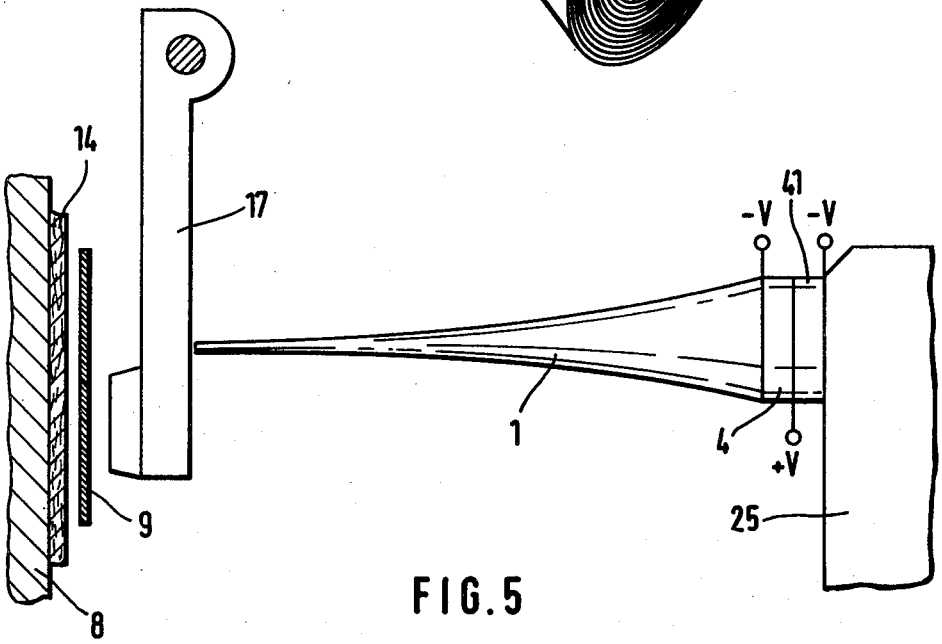
FIG. 5 is a schematic elevational view of a piezoelectrically driven printing element as a drive for the type lever in a mechanical high-speed chain printer.

FIG. 5 shows schematically a type lever 17 present in the e.g. mechanical chain printer 3211 of the IBM Company and driven by the embodiment of the piezoelectrically operated printing system described in FIG. 2A.

Instead of the relatively rigid type lever in the abovementioned chain printer, the type lever of a type wheel printer or the needle of a conventional matrix printer can also be driven by the booster tip of the described piezoelectrically operated printing unit, whilst the conventional electromagnetic drive is replaced by the described piezoelectrically operated printing element.

With the majority of piezoceramics it is necessary for the piezoelectrical drive elements 4 and 41, and optionally the control element 42, to be pretensioned by an optimally selected printing tension when these elements are required to be subjected to major expansions, because although piezoceramics can withstand high compressive stresses, they cannot withstand high tensile stresses. It is possible by a compressive pretensioning to achieve that the piezoelectrical drive elements oscillate only in the so-called "compression range".

In the printing process described, the ink carrier 9 may also be replaced by pressure-sensitive ink powder or ink mist, preferably in aerosol form, moved past between the booster tip and the record carrier 14. The possible smaller deflection of the booster tip thereby achieved permits higher printing frequencies by a shorter booster length and/or lower mechanical material stresses and/or smaller cross-sectional proportions of the booster.

The invention may be embodied in other specific forms without departing from the spirit or essential characteristics thereof. The embodiments are therefore to be considered in all respects as illustrative and not restrictive.

For example, the application of the invention is not restricted to printers. Other applications are also possible, e.g. in embossing and stamping machines.

What is claimed is:

1. A matrix printer comprising (a) means defining a support surface;

(b) a record carrier arranged for movement along said support surface;

(c) an ink carrier adjacent the surface of said record carrier opposite said support surface means;

(d) a plurality of printing elements, each in the form of a horn-shaped, tapered, hyperbolic tube configuration with a narrow free end and a wide end, said printing element being arranged with said narrow free end, in its normal position, adjacent the surface of said ink carrier opposite said record carrier;

(e) guide means for guiding said narrow free end of each of said printing elements;

(f) at least one piezoelectric drive element abutting said wide end of each of said printing elements, said at least one piezoelectric drive element including a positive electrode and negative electrode thereon; and (g) support means for supporting said at least one piezoelectric drive element abutting said wide end of each os said printing elements;

(h) whereby upon application of an electrical pulse to said electrodes of said at least on piezoelectric drive element of each of said printing elements, a shock wave travels along said printing element and said narrow free end of said printing element is caused to be deflected towards said record carrier to directly make an impression through said ink carrier on said record carrier and to be returned to its normal position.

2. A matrix printer as defined in claim 1 comprising a plurality of piezoelectric drive elements arranged in series, the first of said piezoelectric elements abutting said wide end of each of said printing elements, said piezoelectric drive elements being arranged with said positive electrodes and negative electrodes of adjacent piezoelectric drive elements in contiguous relationship.

3. A matrix printer as defined in claim 2 wherein said support means comprises a bracing element abutting the end piezoelectric drive element remote from said printing element, said bracing element being adapted to absorb shock waves induced by said piezoelectric drive elements.

4. A matrix printer as defined in claim 2 wherein said piezoelectric drive elements and said printing elements have the same natural frequency to minimize prejudicial reflections of the shock waves.

5. A matrix printer as defined in claim 3 wherein said piezoelectric drive elements, said printing elements and said bracing elements have the same natural frequency to minimize prejudicial reflections of the shock waves.

6. A matrix printer comprising (a) means defining a support surface;

(b) a record carrier arranged for movement along said support surface;

(c) an ink carrier adjacent the surface of said record carrier opposite said support surface means;

(d) a plurality of printing elements, each in the form of a horn-shaped, tapered, hyperbolic tube configuration with a narrow free end and a wide end, said printing element being arranged with said narrow free end, in its normal position, adjacent the surface of said ink carrier opposite said record carrier;

(e) guide means for guiding said narrow free end of each of said printing elements;

(f) at least one piezoelectric drive element abutting said wide end of each of said printing elements, said at least one piezoelectric drive element including a positive electrode and a negative electrode thereon; and (g) support means comprising a from and a membrane extending between said frame and said at least one piezoelectric electric drive element;

(h) whereby upon application of an electrical pulse to said electrodes of said at least one piezoelectric drive element of each of said printing elements, a shock wave travels along said printing elements and said narrow free end of said printing element is caused to be deflected towards said record carrier to directly make an impression through said ink carrier on said record carrier and to be returned to its normal position.

7. A matrix printer as defined in claim 6 wherein said membrane is electrically conductive and constitutes an electrode of said at least one piezoelectric drive element.

8. A matrix printer as defined in claim 6 comprising a plurality of piezoelectric drive elements arranged in series, the first of said piezoelectric elements abutting said wide end of each of said printing elements, said piezoelectric drive elements being arranged with said positive electrodes and negative electrodes of adjacent piezoelectric drive elements in contiguous relationship.

9. A matrix printer as defined in claim 8 wherein said piezoelectric drive elements and said printing elements have the same natural frequency to minimize prejudicial reflections of the shock waves.

10. A matrix printer as defined in claim 8 wherein said piezoelectric drive elements, said printing elements and said membrane have the same natural frequency to minimize prejudicial reflections of the shock waves.

11. A matrix printer comprising (a) means defining a support surface;

(b) a record carrier arranged for movement along said support surface;

(c) an ink carrier adjacent the surface of said record carrier opposite said support surface means;

(d) a plurality of printing elements, each in the form of a horn-shaped, tapered, hyperbolic tube configuration with a narrow free end and a wide end, said printing element being arranged with said narrow free end, in its normal position, adjacent the surface of said ink carrier opposite said record carrier, said printing element being in the form of a lambda semi-oscillator having a collar intermediate the opposite ends thereof for mounting said printing element in the position of the oscillation node of the overall oscillating system;

(e) guide means for guiding said narrow free end of each of said printing elements; and (f) at least one piezoelectric drive element abutting said wide end of each of said printing elements, said at least one piezoelectric drive element including a positive electrode and a negative electrode thereon;

(g) whereby upon application of an electrical pulse to said electrodes of said at least one piezoelectric drive element of each of said printing elements, a shock wave travels along said printing element and said narrow free end of said printing element is caused to be deflected towards said record carrier to directly make an impression through said ink carrier on said record carrier and to be returned to its normal position.

12. A matrix printer as defined in claim 11 comprising a plurality of piezoelectric drive elements arranged in series, the first of said piezoelectric elements abutting said wide end of each of said printing elements, said piezoelectric drive elements being arranged with said positive electrodes and negative electrodes of adjacent piezoelectric drive elements in contiguous relationship.

13. A matrix printer as defined in claim 12 wherein said piezoelectric drive elements and said printing elements have the same natural frequency to minimize prejudicial reflections of the shock waves.

* * * * *